US006358369B1

(12) United States Patent
Yoshida et al.

(10) Patent No.: US 6,358,369 B1
(45) Date of Patent: Mar. 19, 2002

(54) PRESS FELT FOR MAKING PAPER

(75) Inventors: Nobuo Yoshida, Chofu; Atsushi Ishino, Ibaragi-ken; Kenji Inoue, Ibaragi-ken; Harushige Ikeda, Ibaragi-ken, all of (JP)

(73) Assignee: Ichikawa Co., Ltd., Tokyo (JP)

( * ) Notice: Subject to any disclaimer, the term of this patent is extended or adjusted under 35 U.S.C. 154(b) by 0 days.

(21) Appl. No.: 09/532,562

(22) Filed: Mar. 22, 2000

(30) Foreign Application Priority Data

Mar. 24, 1999 (JP) ..... 11-079365

(51) Int. Cl.[7] ..... D21F 3/00

(52) U.S. Cl. ..... 162/358.2; 162/358.1; 162/900; 428/218; 428/286; 428/96; 428/212; 428/287; 428/234; 139/383 A

(58) Field of Search ..... 162/358.2, 358.1, 162/900; 428/218, 286, 96, 212, 287, 234; 139/383 A

(56) References Cited

U.S. PATENT DOCUMENTS 4,988,409 A * 1/1991 Nyberg ..... 162/358
5,182,164 A * 1/1993 Eklund et al. ..... 428/234
5,372,876 A * 12/1994 Johnson et al. ..... 428/233

FOREIGN PATENT DOCUMENTS

JP 127590/1990 5/1990

* cited by examiner

*Primary Examiner*—Stanley S. Silverman
*Assistant Examiner*—Mark Halpern
(74) *Attorney, Agent, or Firm*—Pearne & Gordon LLP

(57) ABSTRACT

A paper-making press felt (1) includes a base member (2) and at least one batt layer (3) laminated on the base member (2), and is characterized in that the base member (2) is made of a plurality of ground fabrics, and in that, of the plurality of ground fabrics, a second ground fabric (B) arranged next to a first ground fabric (A) arranged nearest to a surface (4) on which a wet paper sheet is placed has a structure whose density is higher than or whose air permeability is lower than that of the first ground fabric (A), and can regulate water from moving from the second ground fabric (B) to the first ground fabric (A) and hence can prevent a re-wetting phenomenon effectively.

21 Claims, 8 Drawing Sheets

FIG. 14

| | faric | | | | function | | |
|---|---|---|---|---|---|---|---|
| | fabric density g/cm³ | specific density | air permeability cc/cm²/sec | specific air permeability | water-squeezing capability | re-wetting capability | water content of wet paper |
| present embodiment felt (a) | top ①:0.32 | ②/① | 630 | ②/① | good | excellent | 53% |
| | bottom ②:0.55 | 1.72 | 275 | 0.44 | | | |
| comparative felt (a) | top ①:0.32 | ①/① | 630 | ①/① | excellent | no good | 55% |
| | bottom ①:0.32 | 1.00 | 630 | 1.00 | | | |
| comparative felt (b) | top ②:0.55 | ①/② | 275 | ①/② | no good | no good | 55% |
| | bottom ①:0.32 | 0.58 | 630 | 2.29 | | | |

FIG. 15

| | fabric | | | | function | | |
|---|---|---|---|---|---|---|---|
| | fabric density g/cm³ | specific density | air permeability cc/cm²/sec | specific air permeability | water-squeezing capability | re-wetting capability | water content of wet paper sheet |
| present embodiment felt (b) | top ③:0.21 | ④/③ | 800 | ④/③ | excellent | excellent | 51% |
| | middle ④:0.35 | 1.7 | 70 | 0.09 | | | |
| | bottom ⑤:0.32 | | 630 | | | | |
| present embodiment felt (c) | top ③:0.21 | ⑤/③ | 800 | ⑤/③ | excellent | good | 52% |
| | bottom ⑤:0.32 | 1.5 | 630 | 0.79 | | | |
| present embodiment felt (d) | top ⑤:0.32 | ④/⑤ | 630 | ④/⑤ | good | good | 52% |
| | bottom ④:0.35 | 1.1 | 70 | 0.11 | | | |
| comparative embodiment felt (c) | top ④:0.35 | ⑤/④ | 70 | ⑤/④ | no good | no good | 54% |
| | bottom ⑤:0.32 | 0.9 | 630 | 9 | | | |

PRESS FELT FOR MAKING PAPER

BACKGROUND OF THE INVENTION

The present invention relates to a paper-making press felt having good water-squeezing capability.

Conventionally, in a press part in a paper-making process, a water-squeezing operation is performed by pinching a paper-making press felt on which a wet paper sheet is placed by a pair of press rolls and by applying pressure thereto. At the nip press of the pair of press rolls, the felt is rapidly released from a press state in a region from a nip center to the delivery side of the rolls and hence expands its volume markedly. This produces a phenomenon that a large amount of water moves from fine fibers to the wet paper sheet by a capillary phenomenon in the process of volume expansion.

The phenomenon is called a re-wetting phenomenon, and is well known to a person skilled in the art. When the re-wetting phenomenon is generated, the water-squeezing efficiency is reduced at a press part, and hence various kinds of methods have been used to prevent the phenomenon.

A first method for preventing the re-wetting phenomenon was to reduce the amount of water moving to a wet paper sheet by using fibers smaller than the fibers constituting the wet paper sheet for the fibers constituting the batt layer of a felt, and the second method was to reduce the amount of water moving to the wet paper sheet by providing a felt with a hydrophilic resin layer and a hydrophobic resin layer, as disclosed in Japanese Published Unexamined Patent Application No. x2x-127590/1990.

However, the first method described above has a drawback that if the fibers of a batt layer are smaller than the pulp fibers of the wet paper sheet, a felt tends to get dirty and that fibers tend to come off markedly. Also, the second method described above has a fear that an additive or an oil component contained in the wet paper sheet will be fixed to or accumulated on the hydrophilic resin layer or the hydrophobic resin layer, or conversely, that these resin layers are melted and removed little by little, and hence has a problem that the felt can not have sufficient durability as a paper-making press felt.

SUMMARY OF THE INVENTION

The present invention has been made to solve the problems described above. It is the object of the present invention to provide a paper-making press felt which can effectively prevent a re-wetting phenomenon and can provide a user with excellent usability without using fibers smaller than the fibers constituting a wet paper sheet for the fibers forming the batt layer of a felt and without using hydrophilic resin and hydrophobic resin.

In order to accomplish the object described above, a paper-making press felt in accordance with the present invention includes a base member and at least one batt layer laminated on the base member and is characterized in that the base member is made of a plurality of ground fabrics, and in that, of the plurality of ground fabrics, a second ground fabric arranged next to a first ground fabric arranged nearest to a surface on which a wet paper sheet is placed is a structure whose density is higher than that of the first ground fabric, and can regulate water from moving from the second ground fabric to the first ground fabric by the difference in density between them and can prevent a re-wetting phenomenon effectively.

Also, a paper-making press felt can include a base member and at least one batt layer laminated on the base member, and is characterized in that the base member has a two-layer structure of a first ground fabric arranged nearest to a surface on which a wet paper sheet is placed and a second ground fabric arranged next to the first ground fabric, and in that the second ground fabric is a structure whose density is higher than that of the first ground fabric, and can regulate water from moving from the second ground fabric to the first ground fabric by the difference in density between them and can prevent a re-wetting phenomenon effectively in the case of the base member having the two-layer structure.

Further, a paper-making press felt can include a base member and at least one batt layer laminated on the base member, and is characterized in that the base member has a three-layer structure of a first ground fabric arranged nearest to a surface on which a wet paper sheet is placed, a second ground fabric arranged next to the first ground fabric, and a third ground fabric arranged next to the second ground fabric, and in that the second ground fabric is a structure whose the density is higher than that of the first ground fabric, or that of the first ground fabric and that of the third ground fabric, and can regulate water from moving from the second ground fabric to the first ground fabric by the difference in density between them and can prevent a re-wetting phenomenon effectively in the case of the base member having the three-layer structure.

Still further, a paper-making press felt can include a base member and at least one batt layer laminated on the base member, and is characterized in that the base member is made of a plurality of ground fabrics and in that, of the plurality of ground fabrics, a second ground fabric arranged next to a first ground fabric arranged nearest to a surface on which a wet paper sheet is placed is a structure whose air permeability is lower than that of the first ground fabric, and can regulate water from moving from the second ground fabric to the first ground fabric by the difference in air permeability between them and can prevent a re-wetting phenomenon effectively.

A paper-making press felt can include a base member and at least one batt layer laminated on the base member, and is characterized in that the base member has a two-layer structure of a first ground fabric arranged nearest to a surface on which a wet paper sheet is placed and a second ground fabric arranged next to the first ground fabric, and in that the second ground fabric is a structure whose air permeability is lower than that of the first ground fabric, and can regulate water from moving from the second ground fabric to the first ground fabric by the difference in air permeability between them and can prevent a re-wetting phenomenon effectively in the case of the base member having the two-layer structure.

Still further, a paper-making press felt can include a base member and at least one butt layer laminated on the base member, and is characterized in that the base member has a three-layer structure of a first ground fabric arranged nearest to a surface on which a wet paper sheet is placed, a second ground fabric arranged next to the first ground fabric, and a third ground fabric arranged next to the second ground fabric, and in that the second ground fabric is a structure whose air permeability is lower than that of the first ground fabric, or that of the first ground fabric and that of the third, and can regulate water from moving from the second ground fabric to the first ground fabric by the difference in density between them and can prevent a re-wetting phenomenon effectively in the case of the base member having the three-layer structure ground.

Still further, a paper-making press felt can be characterized in that the first ground fabric has, or the first ground fabric and the third ground fabric have an air permeability of 50 cc/cm$^2$ to 900 cc/cm$^2$ and in that the second ground fabric has an air permability of 0.67 or less, which makes it possible to select the specific value of density for unerringly realizing the prevention of re-wetting phenomen.

Still further, a paper-making press felt can be characterized in that the first ground fabric is made of, or the first ground fabric and the third ground fabric and the second ground fabric are made of monofilament single yarns of 50 d to 330 d or twist yarns thereof, which makes it possible to select the specific material and the size of yarn for unerringly realizing the prevention of a re-wetting phenomenon.

Still further, a paper-making press felt can be characterized in that the second ground fabric is made of a non-woven fabric or a laminated body of non-woven fabrics, which can provide flexibility in selecting the material of the second ground fabric as long as the material selected for the second ground fabric satisfies the conditions of density and specific density, or air permeability and specific air permeability to the first ground fabric.

BRIEF DESCRIPTION OF THE DRAWINGS

FIG. 14 is an illustration of a comparison table of function among a felt body (a) in accordance with the present invention, a comparative felt (a) and a comparative felt (b).

FIG. 15 is an illustration of a comparison table of function among a felt body (b) in accordance with the present invention, a comparative felt (c) and a comparative felt (d).

DESCRIPTION OF THE PREFERRED EMBODIMENTS

Figure 1:
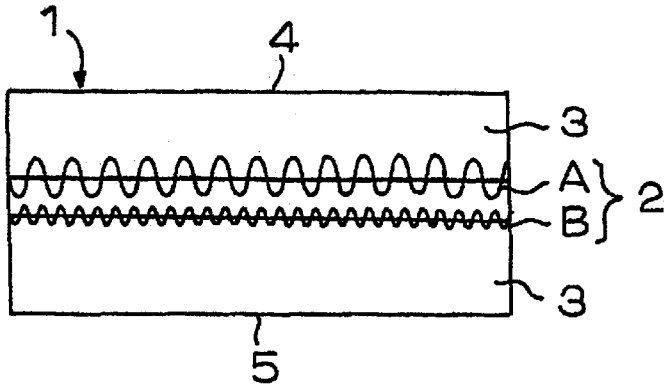
FIG. 1 is a schematic cross-sectional view of a felt body in accordance with the present invention whose base member has a two-layer structure.

The embodiments of the present invention will be described based on FIG. 1 to FIG. 12. In the drawings, a reference numeral 1 designates a paper-making press felt body in accordance with the present invention (hereinafter referred to as "a felt body in accordance with the present invention") and, as shown in FIG. 1, the felt body 1 in accordance with the present invention includes a base member 2 and batt layers 3 laminated on the base member 2. The base member 2 has a two -layer structure of a first ground fabric A and a second ground fabric B.

Figure 2:
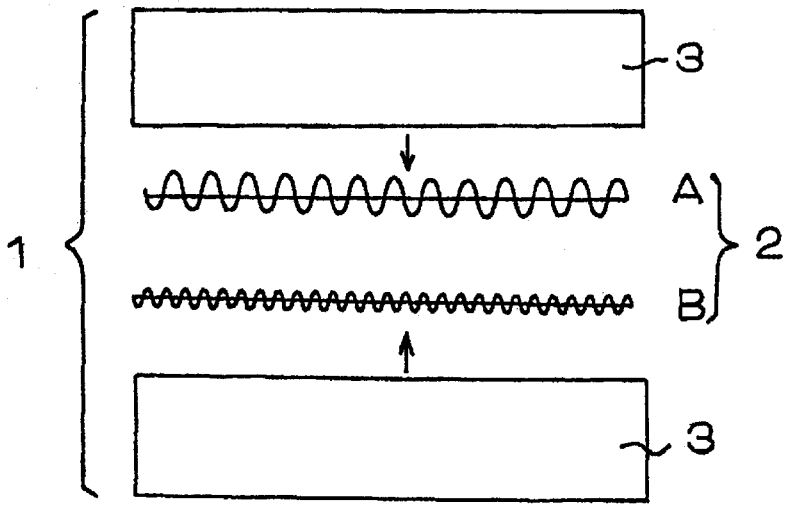
FIG. 2 is an exploded cross-sectional view of a felt body in accordance with the present invention whose base member has a two-layer structure.

The above-mentioned batt layers 3 are formed on both surfaces of the felt body 1 in accordance with the present invention, that is, on both surfaces of the base member 2, and one surface thereof is a surface 4 on which a wet paper sheet is placed and the other surface is a press roll contact surface 5. To be more specific, the batt layers 3 are formed in the following way: the endless first ground fabric A is overlaid on the endless second ground fabric B to form an endless base member 2, as shown in FIG. 2, and then the batt layers 3 are laminated on the base member 2 and flocked by a needle punching method while a predetermined tension is being applied to the base member 2 between two axes not shown in the drawing.

The second ground fabric B arranged at the side of the press roll contact surface 5 is a structure having a higher density compared with the first ground fabric arranged nearest to the surface 4 on which a wet paper sheet is placed, where the density means an apparent density (g/cm$^3$) determined by dividing weight (g/cm$^2$) by thickness (mm).

As described above, it is because it is intended to regulate water from coming into the first ground fabric A from the second ground fabric B that the second ground fabric B is a structure having a higher density compared with the first ground fabric A. As a result, this can prevent a re-wetting phenomenon effectively (see an arrow Y2 in FIG. 12).

It was found by experiments that the specific condition of density for preventing the re-wetting phenomenon effectively was as follows: the first ground fabric A had a density of 0.15 g/cm$^3$ to 0.50 g/cm$^3$ and the second ground fabric B had a density of 0.23 g/cm$^3$ to 0.75 g/cm$^3$ and a specific density (a ratio of the density of the second ground fabric B to the density of the first ground fabric A) was 1.5 or more. That is, the specific density of less than 1.5 results in making it difficult to keep a necessary water-squeezing capability.

Also, an air permeability has an effect on the prevention of the re-wetting phenomenon. It was found by experiments that the specific condition of air permeability was as follows: the first ground fabric A had an air permeability of 50 cc/cm$^2$to 900 cc/cm$^2$ and the second ground fabric B had an air permeability of 32 cc/cm$^2$ to 600 cc/cm$^2$ and a specific air permeability (a ratio of the air permeability of the second ground fabric B to the air permeability of the first ground fabric A) was 0.67 or less. That is, the specific air permeability of more than 0.67 results in making it difficult to keep a necessary water-squeezing capability in the case where the ground fabrics A, B are woven fabric structures.

In this respect, the above-mentioned density and air permeability were measured by a method (fragile type testing machine) standardized in JIS L 1096 (Testing Methods for Fabrics).

It is effective that the first ground fabric A and the second ground fabric B are made of monofilament single yarns of 50 d to 330 d or twist yarns thereof, respectively. That is, in the case where yarns made of the monofilament single yarns of smaller than 50 d or larger than 330 d or the twist yarns thereof are used, it is extremely difficult to weave a ground fabric having the above-mentioned structure. In this respect, a single plain weave or a double twill weave is suitable for the weave texture of the first ground fabric A and the second ground fabric B.

Figure 3:
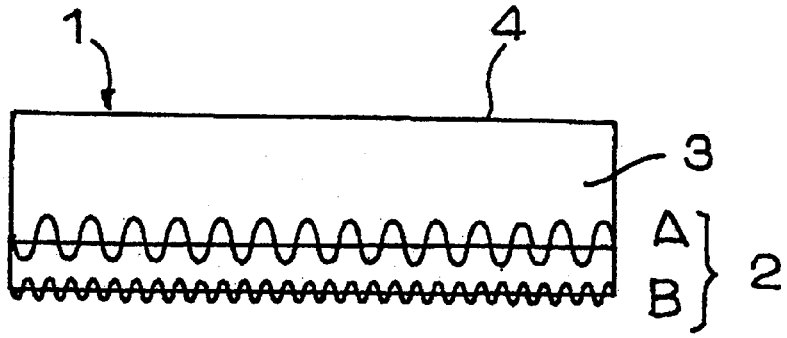
FIG. 3 is a schematic cross-sectional view of a felt body in accordance with the present invention whose base member has a two-layer structure and has a batt layer on one side thereof.

In this connection, while the felt body 1 in accordance with the present invention has the batt layers 3 on both surfaces of the base member 2 in the embodiments shown in FIG. 1 and FIG. 2, it is needless to say that the felt body 1 in accordance with the present invention includes a felt shown in FIG. 3 in which the batt layer 3 is formed only at the side of the surface 4 on which a wet sheet is placed.

Next, another embodiment will be described based on FIG. 4. According to FIG. 4, a base member 2 has a three-layer structure of a first ground fabric A arranged nearest to a surface 4 on which a wet paper sheet is placed, a third ground fabric C arranged at the side of a press roll contact surface 5, and a second ground fabric B arranged between these ground fabrics A, C. The second ground fabric B arranged in the middle is a structure having a larger density compared with the first ground fabric A and the third ground fabric C. This is because it is intended to regulate water from coming into the side of the first ground fabric A from the side of the second ground fabric B and to prevent the re-wetting phenomenon effectively.

Figure 4:
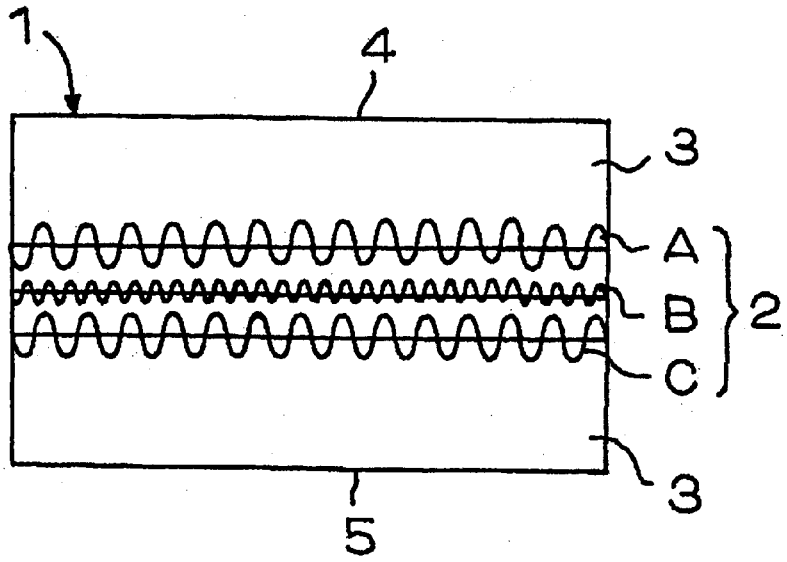
FIG. 4 is a schematic cross-sectional view of a felt body in accordance with the present invention whose base member has a three-layer structure.

In a structure shown in FIG. 4, the yarns constituting the base member 2, the structure of the ground fabric, and the conditions of density and air permeability are the same as those in the case described above, and there is no problem in forming the third ground fabric C under the same conditions as the first ground fabric A.

That is, it was found by experiments that each of the first and third ground fabrics A, C had a density of 0.15 g/cm$^3$ to 0.50 g/cm$^3$ and that the second ground fabric B had a density of 0.23 g/cm$^3$ to 0.75 g/cm$^3$ and that a specific density (a ratio of the density of the second ground fabric B to the density of the first ground fabric A or the third ground fabric C) was 1.5 or more. That is, the specific density of less than 1.5 results in making it difficult to keep a necessary water-squeezing capability.

Also, as for the conditions of air permeability, as is the case described above, it was found by experiments that, each of the first ground fabrics A and the third ground fabric C had an air permeability of 50 cc/cm$^2$ to 900 cc/cm$^2$ and that the second ground fabric B had an air permeability of 32 cc/cm$^2$ to 600 cc/cm$^2$ and that a specific air permeability (a ratio of the air permeability of the second ground fabric B to the air permeability of the first ground fabric A and the third ground fabric C) was 0.67 or less. That is, the specific air permeability of more than 0.67 results in making it difficult to keep a necessary water-squeezing capability in the case where the ground fabrics A, B are woven fabric structures.

It is effective that the first ground fabric A, the second ground fabric B, and the third ground fabric C are made of monofilament single yarns of 50 d to 330 d or twist yarns thereof, respectively. That is, in the case where yarns made of the monofilament single yarns of smaller than 50 d or more than 330 d or the twist yarns thereof are, used, it is extremely difficult to weave the ground fabric having the above-mentioned specific structure. In this respect, as is the case in FIG. 1, a single plain weave or a double twill weave is suitable for the weave texture of the first ground fabric A and the second ground fabric B.

In this connection, while the ground fabric constituting the base member 2 shown as the above-mentioned embodiment has two layers or three layers, it is not intended to limit the number of layer to these values but it is possible to achieve the object and effects of the present invention even by using a base member made of still more layers of ground fabrics.

Figure 5:
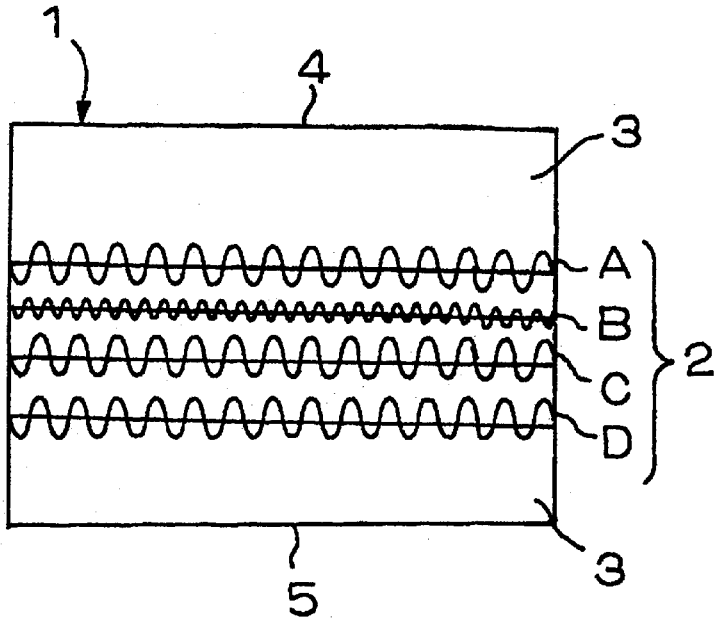
FIG. 5 is a schematic cross-sectional view of a felt body in accordance with the present invention whose base member has a four-layer structure.

Here, one embodiment of the felt body 1 in accordance with the present invention having three or more layers of ground fabrics will be shown in FIG. 5. According to FIG. 5, a base member 2 has a four-layer structure including a first ground fabric A arranged nearest to a surface 4 on which a wet paper sheet is placed, a second ground fabric B arranged next to the first ground fabric A, a third ground fabric C arranged next to the second ground fabric B, and a fourth ground fabric D arranged at the side of a press roll contact surface 5.

In the constitution of the base member 2 having the above four-layer structure, the second ground fabric B, which is arranged next to the first ground fabric A arranged nearest to a surface 4 on which a wet paper sheet is placed, is a structure having a higher density than the first ground fabric A.

In this connection, the suitable density, specific density, air permeability, specific air permeability of each of the first ground fabric A and the second ground fabric B, and the yarns constituting both the ground fabrics are the same as those of the embodiment described above. Also, the structures of the third ground fabric C and the fourth ground fabric D may be common to the first ground fabric A and can be suitably selected according to the desired characteristics of the felt body in accordance with the present invention.

That is, according to the present invention, in a paper-making press felt whose base member is formed of at least two or more layers of ground fabrics, a ground fabric (second ground fabric) arranged next to a ground fabric (first ground fabric) arranged nearest to a surface on which a wet paper sheet is placed is a structure whose density is higher than or whose air permeability is lower than that of the ground fabric (first ground fabric) arranged nearest to a surface on which a wet paper sheet is placed, and hence can regulate water from coming into the first ground fabric from the second ground fabric and can prevent a re-wetting phenomenon effectively.

Figure 6:
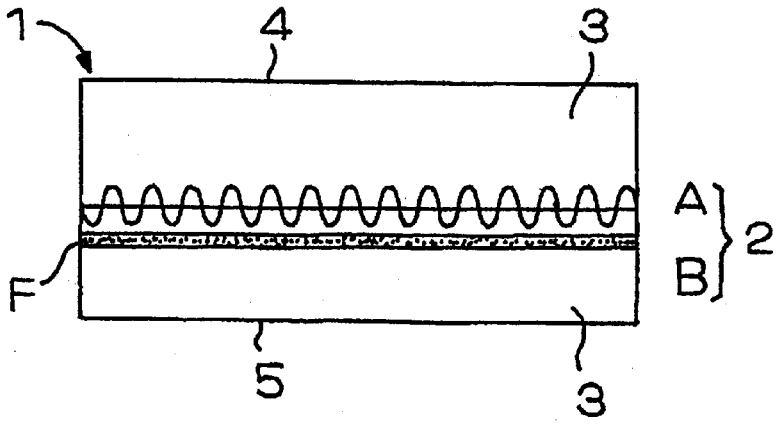
FIG. 6 is a schematic cross-sectional view of a felt body in accordance with the present invention whose base member has a two-layer structure including a non-woven fabric in a second ground fabric.

In this regard, while the second ground fabric B is made of a woven fabric structure having a high density in the embodiment described above, instead of the woven fabric, as shown in FIG. 6, it may be formed of a non-woven fabric F (including a laminated body made of non-woven fabrics, same in the following). The non-woven fabric F is formed by a needle punching method, a spun bond method, a spun lace method, or the like.

Figure 7:
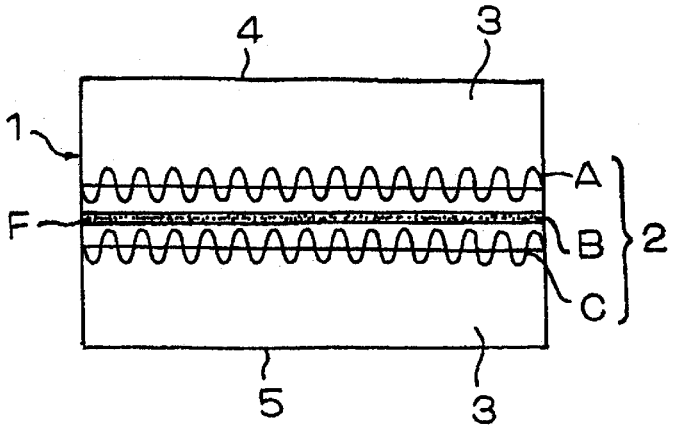
FIG. 7 is a schematic cross-sectional view of a felt body in accordance with the present invention whose base member has a three-layer structure including a non-woven fabric in a second ground fabric.

That is, according to FIG. 6, a base member 2 has a two-layer structure including a first ground fabric A made of a woven fabric and a second ground fabric made of a non-woven fabric F, and according to FIG. 7, a base member 2 has a three-layer structure including a first ground fabric A and a third ground fabric C, both of which are made of woven fabrics, and a second ground fabric B made of a non-woven fabric F. The second ground fabric B made of the non-woven fabric F is a structure having a higher density or a lower air permeability compared with the first ground fabric A and a third ground fabric C and a higher density than the above-mentioned batt layer 3.

Figure 8:
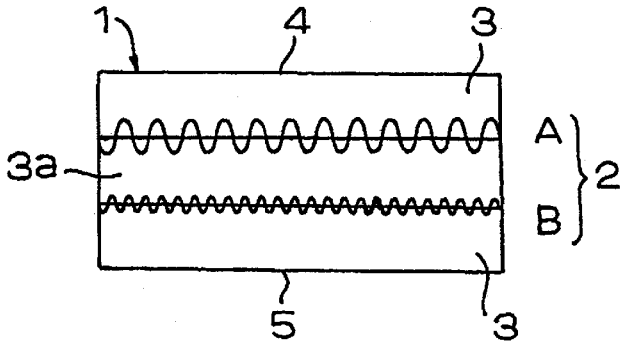
FIG. 8 is a schematic cross-sectional view of a felt body in accordance with the present invention whose base member has a two-layer structure including a batt layer between ground fabrics.
Figure 9:
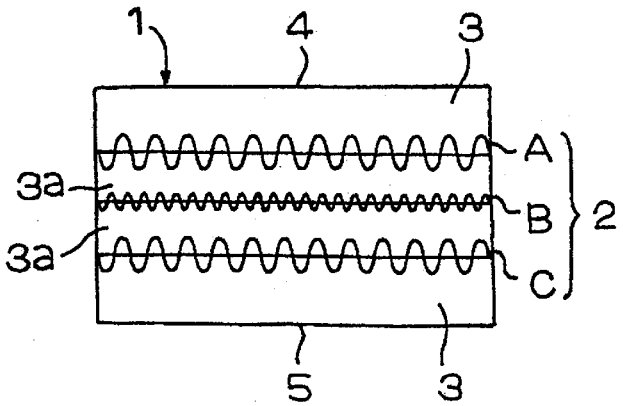
FIG. 9 is a schematic cross-sectional view of a felt body in accordance with the present invention whose base member has a three-layer structure including a batt layer between ground fabrics.
Figure 10:
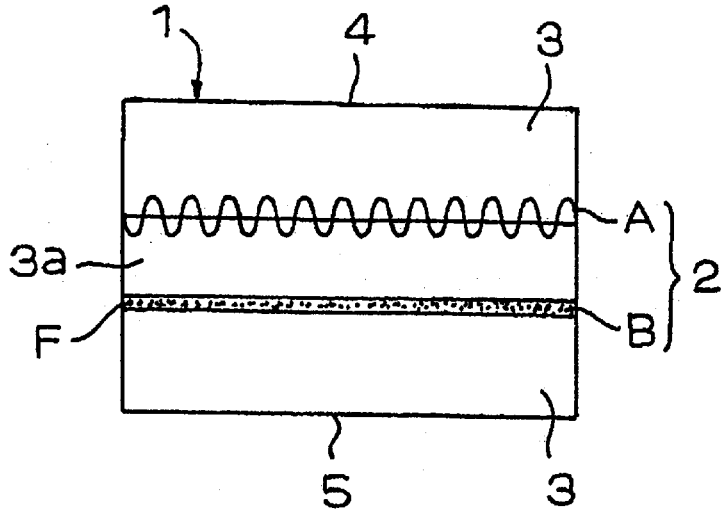
FIG. 10 is a schematic cross-sectional view of a felt body in accordance with the present invention whose base member has a two-layer structure including a non-woven fabric in a second ground fabric and a batt layer between ground fabrics.

In the embodiments shown in FIG. 1 to FIG. 7, a plurality of ground fabrics constituting the base member 2 are simply overlaid, but as shown in FIG. 8 to FIG. 10, it is possible to form a batt layer 3a between these ground fabrics. That is, in order to form a felt body 1 in accordance with the present invention, it is recommended that a batt layer be laminated between the plurality of ground fabrics and be fixed to the ground fabrics by the needle punching method, and that the ground fabrics be overlaid to form a base member 2, and that a batt layer be laminated on the base member 2 and be flocked by the needle punching method.

Figure 11:
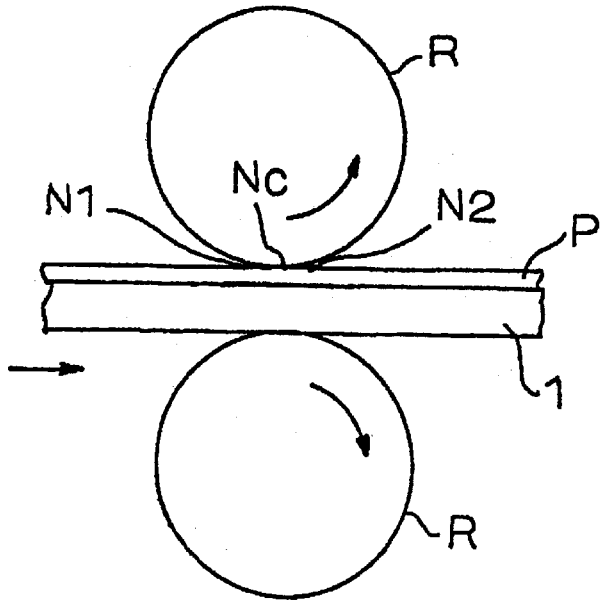
FIG. 11 is a schematic cross-sectional view illustrating a state where a felt body in accordance with the present invention is used.

The action of the paper-making press felt body 1 described in the above embodiments will be described based on FIG. 11 and FIG. 12. The paper-making press felt body 1 is moved in the press part of a paper-making machine with a wet paper sheet P placed thereon, as shown in FIG. 11, and is pinched by a pair of press rolls R, whereby water is squeezed from the wet paper sheet.

In a nip press from N1 to N2 by the pair of press rolls R, a large amount of water is squeezed from the wet paper sheet P in the region from a nip entry N1 to a nip center Nc. Here, the water passes without a hitch through the batt layer 3, the first ground fabric A, and the second ground fabric B as shown by an arrow Y1.

The felt body 1 in accordance with the present invention is released from a press state in the region from the nip center Nc to the nip delivery N2 to expand its volume. Therefore, water described above tends to move toward the wet paper sheet P as shown by an arrow Y2 (this is called a re-wetting phenomenon), but since the second ground fabric B has a higher density or a lower air permeability than the first ground fabric A, the second ground fabric B makes it difficult for the water to move from the second ground fabric B to the first ground fabric A, which results in reducing the amount of water returned to the wet paper sheet (preventing the re-wetting phenomenon).

Figure 13:
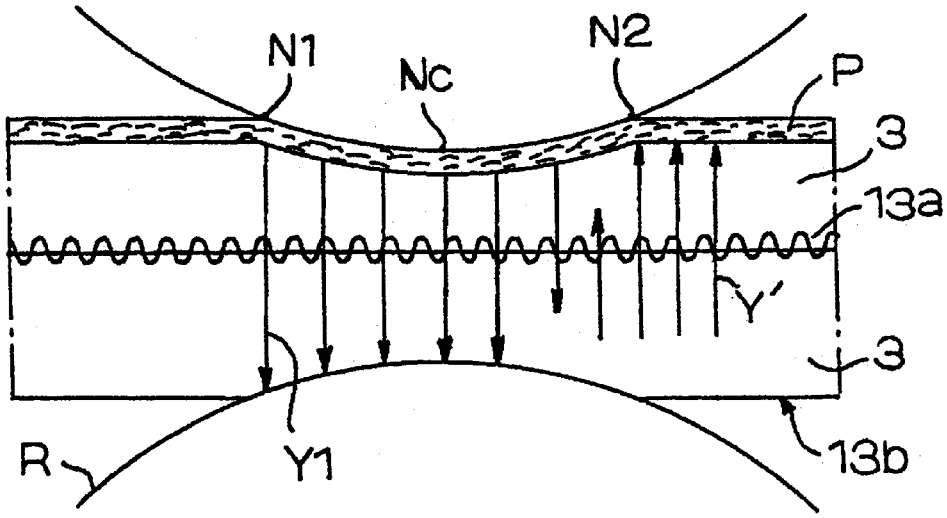
FIG. 13 PRIOR ART
FIG. 13 is an enlarged cross-sectional view illustrating the action of a conventional felt body in a state where it is pressed.

On the other hand, as shown in FIG. 13, in a conventional case where a ground fabric 13*a* has not the structure in accordance with the present invention, when a conventional press felt body 13*b* is released from a press state to expand its volume, the water described above moves without resistance to the wet paper sheet P as shown by an arrow Y', which results in producing the re-wetting phenomenon.

Figure 12:
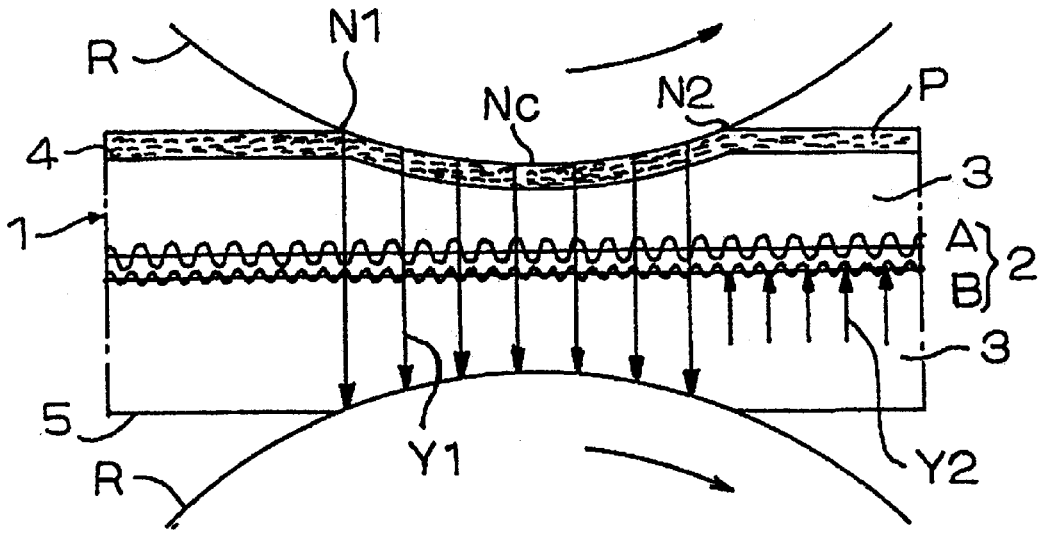
FIG. 12 is an enlarged cross-sectional view illustrating the action of a felt body in accordance with the present invention in a state where it is pressed.

In this connection, while the constitution of the base member 2 shown in FIG. 1 is shown in FIG. 12 as the constitution of the base member 2, it is needless to say that the base member 2 having the constitution shown in FIG. 3 to FIG. 10 can also prevent the re-wetting phenomenon on the same principle. In particular, if the base member 2 has the ground fabrics of a three-layer structure or a multiple-layer structure, it can keep larger water volume when it is pressed and hence can further improve water-squeezing capability as a paper-making press felt.

EMBODIMENT 1

First, a ground fabric (1) and a ground fabric (2) were formed under the following conditions:

a ground fabric (1); an endless fabric having a weave density of 0.32 g/cm$^3$ and an air permeability of 630 cc/cm$^2$/sec, which was woven by using twist yarns made of monofilaments 2/2/220 d prepared as warps on a loom and the same twist yarns as inserting yarns.

A ground fabric (2); an endless fabric having a weave density of 0.55 g/cm$^3$ and an air permeability of 275 cc/cm$^2$/sec, which was woven by using twist yarns made of monofilaments 2/2/110 d prepared as warps on a loom and monofilament single yarns of 110 d as inserting yarns.

The above-mentioned ground fabric (1) was placed at the side where a wet paper sheet was placed and the ground fabric (2) was underlaid next to the ground fabric (1) to form a base member, and batt layers 3 made of nylon 6 monofilaments (15 d) were laminated on the ground fabric (1) and were punched several turns with needles until a metsuke reached 400 g/cm$^2$, and further, batt layers 3 made of nylon 6 monofilaments (15 d) were laminated on the side of the ground fabric (2) and were punched several turns with needles until a metsuke reached 100 g/cm$^2$. In this way, a felt body in accordance with the present invention (the present embodiment felt (a)) was manufactured.

Also, as a comparative example, a paper-making press felt (comparative felt (a)) was manufactured in the following way: two ground fabrics (1) were overlaid on each other to form a base member and batt layers 3 made of the same material as was used in the embodiment 1 were laminated on both the surfaces of the base member until a metsuke reached the same value as the embodiment Further, as another comparative example, a paper-making press felt (comparative felt (b)) was manufactured in the following way: a ground fabric (2) was arranged at the side where a wet paper sheet was placed and a ground fabric (1) was underlaid next to the ground fabric (2) to form a base member and batt layers 3 made of the same material as was used in the embodiment 1 were laminated on both surfaces of the base member until a metsuke reached the same value as the embodiment 1.

The water-squeezing capability, the prevention capability of re-wetting phenomenon, and the water content of the wet paper sheet after pressing of the present embodiment felt (a), the comparative felt (a), and the comparative felt (b) were measured and the results shown in FIG. 14 were obtained. Here, the water-squeezing capability was judged from the amount of water discharged from a bottom roll (a bottom roll in FIG. 11) when a predetermined force (50 kg/cm) was applied to a pair of press rolls R shown in FIG. 11. The preventing capability of re-wetting phenomenon was judged by continuously weighing (β-ray weighing) the wet paper sheet delivered from the pair of press rolls to which a predetermined force (50 kg/cm) was applied. The water content of the wet paper sheet was judged by measuring the water content of the wet paper sheet delivered from the pair of press rolls R by a predetermined method.

As is evident from the results shown in FIG. 14, it was found that the felt body in accordance with the present invention relating to the present embodiment felt (a) had the better prevention capability of re-wetting phenomenon compared with the comparative felts (a) and (b).

EMBODIMENT 2

Next, three kinds of a ground fabric (3), a ground fabric (4), and a ground fabric (5) were formed under the following conditions:

a ground fabric (3); an endless fabric having a weave density of 0.21 g/cm$^3$ and an air permeability of 800 cc/cm$^2$/sec, which was woven by using twist yarns made of monofilaments 2/2/330 d prepared as warps on a loom and the same twist yarns as inserting yarns.

A ground fabric (4); commercially available polyester spun bond (weight: 150 g/cm$^2$, thickness: 0.47 mm, density: 0.350 g/cm$^3$, air permeability: 70 cc/cm$^2$/sec).

A ground fabric (5); an endless fabric having a weave density of 0.32 g/cm$^3$ and a air permeability of 630 cc/cm$^2$/sec, which was woven by using twist yarns made of monofilaments 2/2/220 d prepared as warps on a loom and the same twist yarns as inserting yarns.

The ground fabric (4) and the ground fabric (3) were overlaid in this order on the ground fabric (5) to form a base member, that is, the ground fabric (3) was arranged at the side where the wet paper sheet was placed and the ground fabric (4) was sandwiched between the ground fabric (3) and the ground fabric (5). Batt fibers made of nylon 6 monofilaments (15 d) were laminated on the side of the ground fabric (3) and were punched several turns with needles until a metsuke reached 300 g/m$^2$, and batt fibers made of nylon 6 monofilaments (15 d) were laminated also on the side of the ground fabric (5) and were punched several turns with needles until a metsuke reached 100 g/m$^2$. In this way, a felt body in accordance with the present invention (present embodiment felt (b)) was manufactured.

Also, the ground fabric (3) was overlaid on the ground fabric 5 to form a base member, and batt fibers made of the same material as was used in the present embodiment felt (b) were laminated on the side of the ground fabric (3) and were punched several turns with needles until a metsuke reached 450 g/m$^2$, and further, batt fibers made of the same material as was used in the present embodiment felt (b) were laminated also on the side of the ground fabric (5) and were punched several turns with needles until a metsuke reached 100 g/m$^2$. In this way, a paper-making press felt (present embodiment felt (c)) was manufactured.

Further, the ground fabric (5) was overlaid on the ground fabric (4) to form a base member, and batt fibers made of the same material as was used in the present embodiment felt (b) were laminated on the side of the ground fabric (5) and were punched several turns with needles until a metsuke reached 450 g/m$^2$, and still further, batt fibers made of the same material as was used in the present embodiment felt (b) were laminated also on the side of the ground fabric (4) and were punched several turns with needles until a metsuke reached 100 g/m$^2$. In this way, a paper-making press felt (present embodiment felt (d)) was manufactured.

Still further, as a comparative example, a paper-making press felt (comparative press felt (c) was manufactured in the following way: the ground fabric (4) was overlaid on the ground fabric (5) to form a base member, and batt fibers made of the same material as was used in the present embodiment felt (b) were laminated on the side of the ground fabric (4) and were punched several turns with needles until its metsuke reached 450 g/m$^2$, and further, batt fibers made of the same material as was used in the present embodiment felt (b) were laminated also on the ground fabric and were punched several turns with needles until a metsuke reached 100 g/m$^2$.

The water-squeezing capability, the prevention capability of re-wetting phenomenon, and the water content of the wet paper sheet after pressing of the present embodiment felts (b), (c), (d), and the comparative felt (c) were measured and the results shown in FIG. 15 were obtained. As is evident from the results shown in FIG. 15, it was found that the felt body in accordance with the present invention relating to the present embodiment felt (b) had the better prevention capability of re-wetting phenomenon compared with the comparative felt (c), and that the present embodiments felts (c) and (d) also had the better prevention capability of re-wetting phenomenon compared with the comparative felt (c).

As described above, a paper-making press felt in accordance with the present invention includes a base member and at least one batt layer laminated on the base member, and is characterized in that the base member is made of a plurality of ground fabrics, and in that, of the plurality of ground fabrics, a second ground fabric arranged next to a first ground fabric arranged nearest to a surface on which a wet paper sheet is placed is a structure whose density is higher than that of the first ground fabric, and hence it can produce an excellent effect of regulating water from moving from the second ground fabric to the first ground fabric by the difference in density between them and of preventing a re-wetting phenomenon.

Also, a paper-making press felt can include a base member and at least one batt layer laminated on the base member, and is characterized in that the base member has a two-layer structure of a first ground fabric arranged nearest to a surface on which a wet paper sheet is placed and a second ground fabric arranged next to the first ground fabric, and in that the second ground fabric is a structure whose density is higher than that of the first ground fabric, and hence it can produce an excellent effect of regulating water from moving from the second ground fabric to the first ground fabric by the difference in density between them and of preventing a re-wetting phenomenon.

Further, a paper-making press felt can include a base member and at least one batt layer laminated on the base member, and is characterized in that the base member has a three-layer structure of a first ground fabric arranged nearest to a surface on which a wet paper sheet is placed, a second ground fabric arranged next to the first ground fabric, and a third ground fabric next to the second ground fabric, and in that the second ground fabric is a structure whose density is higher than that of the first ground fabric, or that of the first ground fabric and that of the third ground fabric. Therefore, the base member has the three-layer structure and is capable of ensuring a larger water volume when it is pressed, and not only improves water-squeezing capability as a paper-making press felt but also produces an excellent effect of regulating water moving from the second ground fabric to the first ground fabric by the difference in density between them and of preventing a re-wetting phenomenon effectively in the case of the base member having the three-layer structure.

Still further, a paper-making press felt can be characterized in that the first ground fabric has, or the first ground fabric and the third ground fabric have a density of 0.15 g/cm$^3$ to 0.50 g/cm$^3$ and in that the second ground fabric has a density of 0.23 g/cm$^3$ to 0.75 g/cm$^3$ and a specific density of 1.5 or more. Therefore, it can produce an excellent effect of selecting a specific value of density to unerringly realize the prevention of a re-wetting phenomenon.

Still further, a paper-making press felt can include a base member and a batt layer laminated on the base member, and is characterized in that the base member is made of a plurality of ground fabrics and in that, of the plurality of ground fabrics, a second ground fabric arranged next to a first ground fabric arranged nearest to a surface on which a wet paper sheet is placed is a structure whose air permeability is lower than that of the first ground fabric. Therefore, it can produce an excellent effect of regulating water from moving from the second ground fabric to the first ground fabric by the difference in air permeability between them and of preventing a re-wetting phenomenon.

Still further, a paper-making press felt can include a base member and at least one batt layer laminated on the base member, and is characterized in that the base member has a two-layer structure of a first ground fabric arranged nearest to a surface on which a wet paper sheet is placed and a second ground fabric arranged next to the first ground fabric, and in that the second ground fabric is a structure whose air permeability is lower than that of the first ground fabric. Therefore, it can produce an excellent effect of regulating water from moving from the second ground fabric to the first ground fabric by the difference in air permeability between them and of preventing a re-wetting phenomenon.

Still further, a paper-making press felt can include a base member and at least one batt layer laminated on the base member, and is characterized in that the base member has a three-layer structure of a first ground fabric arranged nearest to a surface on which a wet paper sheet is placed, a second ground fabric arranged next to the first ground fabric, and a third ground fabric next to the second ground fabric, and in that the second ground fabric is a structure whose air permeability is lower than that of the first ground fabric, or that of the first ground fabric and that of the third ground fabric. Therefore, the base member has the three-layer structure and is capable of ensuring a larger water volume when it is pressed, and not only improves water-squeezing capability as a papermaking press felt but, also produces an excellent effect of regulating water moving from the second ground fabric to the first ground fabric by the difference in air permeability between them and of preventing a re-wetting phenomenon effectively in the case of the base member having the three-layer structure.

Still further, a paper-making press felt can be characterized in that the first ground fabric has, or the first ground fabric and the third ground fabric have an air permeability of 50 cc/cm$^2$ to 900 cc/cm$^2$ and in that the second ground fabric has an air permeability of 32 cc/cm$^2$ to 600 cc/cm$^2$ and a specific permeability of 0.67 or less. Therefore, it can produce an excellent effect of selecting the specific value to unerringly realize the prevention of a re-wetting phenomenon.

Still further, a paper-making press felt can be characterized in that the first ground fabric is made of, or the first ground fabric and the third ground fabric and the second ground fabric are made of monofilament single yarns of 50 d to 330 d or twist yarns thereof. Therefore, it can produce an excellent effect of realizing the prevention of a re-wetting phenomenon by selecting the specific size of yarn used for the second ground fabric and the first ground fabric.

Still further, a paper-making press felt can be characterized in that the second ground fabric is made of a non-woven fabric or a laminated body of non-woven fabrics. Therefore, it can produce an excellent effect of providing wide flexibility in selecting the material of the second ground fabric and of preventing a re-wetting phenomenon.

What is claimed is:

1. A paper-making press felt comprising a base member and at least one batt layer laminated on the base member, characterized in that the base member is made of three or more layers of ground fabrics, and in that, of the plurality of ground fabrics, a second ground fabric arranged next to a first ground fabric arranged nearest to a surface on which a wet paper sheet is placed is a structure whose density is higher than that of the first ground fabric.

2. A paper-making press felt as claimed in claim 1, wherein the first ground fabric has a density of 0.15 g/cm$^3$ to 0.50 g/cm$^3$ and wherein the second ground fabric has a density of 0.23 g/cm$^3$ to 0.75 g/cm$^3$ and a specific density of 1.5 or more.

3. A paper-making press felt as claimed in claim 1, wherein the first ground fabric comprises and the second ground fabric comprise monofilament single yarns of 50 d to 330 d or twist yarns thereof.

4. A paper-making press felt as claimed in claim 3, wherein the second ground fabric comprises a non-woven fabric or a laminated body of non-woven fabrics.

5. A paper-making press felt as claimed in claim 1, wherein the second ground fabric comprises a non-woven fabric or a laminated body of non-woven fabrics.

6. A paper-making press felt comprising a base member and at least one batt layer laminated on the base member, characterized in that the base member has at least a three-layer structure of a first ground fabric arranged nearest to a surface on which a wet paper sheet is placed and a second ground fabric arranged next to the first ground fabric, and in that the second ground fabric is a structure whose density is higher than that of the first ground fabric and at least one additional ground fabric next to the second ground fabric.

7. A paper-making press felt comprising a base member and at least one butt layer laminated on the base member, characterized in that the base member has a three-layer structure of a first ground fabric arranged nearest to a surface on which a wet paper sheet is placed, a second ground fabric arranged next to the first ground fabric, and a third ground fabric arranged next to the second ground fabric, and in that the second ground fabric is a structure whose density is higher than that of the first ground fabric.

8. A paper-making press felt according to claim 7, wherein the density of said second ground fabric is also higher than that of the third ground fabric.

9. A paper-making press felt as claimed in claim 7, wherein the first ground fabric and the third ground fabric have a density of 0.15 g/cm$^3$ to 0.50 g/cm$^3$ and wherein the second ground fabric has a density of 0.23 g/cm$^3$ to 0.75 g/cm$^3$ and a specific density of 1.5 or more.

10. A paper-making press felt as claimed in claim 7, wherein the first ground fabric, the third ground fabric and the second ground fabric comprise monofilament single yarns of 50 d to 330 d or twist yarns thereof.

11. A paper-making press felt as claimed in claim 7, wherein the second ground fabric comprises a non-woven fabric or a laminated body of non-woven fabrics.

12. A paper-making press felt comprising a base member and at least one batt layer laminated on the base member, characterized in that the base member is made of three or more layers of ground fabrics and in that, of the plurality of ground fabrics, a second ground fabric arranged next to a first ground fabric arranged nearest to a surface on which a wet paper sheet is placed is a structure whose air permeability is lower than that of the first ground fabric.

13. A paper-making press felt as claimed in claim 12, wherein the first ground fabric has an air permeability of 50 cc/cm$^2$ to 900 cc/cm$^2$ and wherein the second ground fabric has an air permeability of 32 cc/cm$^2$ to 600 cc/cm$^2$ and a specific permeability of 0.67 or less.

14. A paper-making press felt as claimed in claim 12, wherein the first ground fabric comprises and the second ground fabric comprise monofilament single yarns of 50 d to 330 d or twist yarns thereof.

15. A paper-making press felt as claimed in claim 12, wherein the second ground fabric comprises a non-woven fabric or a laminated body of non-woven fabrics.

16. A paper-making press felt comprising a base member and at least one batt layer laminated on the base member, characterized in that the base member has a two-layer structure of a first ground fabric arranged nearest to a surface on which a wet paper sheet is placed and a second ground fabric arranged next to the first ground fabric sandwiching a batt layer therebetween made integral with said two-layer structure by needle punching, and in that the second ground fabric is a structure whose air permeability is lower than that of the first ground fabric.

17. A paper-making press felt comprising a base member and a batt layer laminated on the base member, characterized in that the base member has a three-layer structure of a first ground fabric arranged nearest to a surface on which a wet paper sheet is placed, a second ground fabric arranged next to the first ground fabric, and a third ground fabric arranged next to the second ground fabric, and in that the second ground fabric is a structure whose air permeability is lower than that of the first ground fabric.

18. A paper-making press felt according to claim 17, wherein the air permeability of said second ground fabric is also lower than that of the third ground fabric.

19. A paper-making press felt as claimed in claim 17, wherein the first ground fabric and the third ground fabric have an air permeability of 50 $cc/cm^2$ to 900 $cc/cm^2$ and wherein the second ground fabric has an air permeability of 32 $cc/cm^2$ to 600 $cc/cm^2$ and a specific permeability of 0.67 or less.

20. A paper-making press felt as claimed in claim 17, wherein the first ground fabric, the third ground fabric and the second ground fabric comprise monofilament single yarns of 50 d to 330 d or twist yarns thereof.

21. A paper-making press felt as claimed in claim 17, wherein the second ground fabric comprises a non-woven fabric or a laminated body of non-woven fabrics.

* * * * *

UNITED STATES PATENT AND TRADEMARK OFFICE

CERTIFICATE OF CORRECTION

PATENT NO. : 6,358,369 B1
DATED : March 19, 2002
INVENTOR(S) : Yoshida et al.

It is certified that error appears in the above-identified patent and that said Letters Patent is hereby corrected as shown below:

Title page,
Item [75], Inventors, please delete "Chofu" and insert therefor -- Tokyo --.

Column 2,
Line 25, insert the following paragraph:
-- Still further, a paper-making press felt can be characterized in that the first ground fabric has, or the first ground fabric and the third ground fabric have a density of 0.15 g/cm$^3$ to 0.50 g/cm$^3$ and in that the second ground fabric has a density of 0.23 g/cm$^3$ to 0.75 g/cm$^3$ and a specific density of 1.5 or more, which makes it possible to select a specific value of density for unerringly realizing the prevention of a re-wetting phenomenon. --

Column 7,
Line 45, please delete "13*a*" and insert therefor -- 13a --.
Line 47, please delete "13*b*" and insert therefor -- 13b --.

Column 8,
Line 27, after "embodiment" please insert -- 1. --.

Signed and Sealed this

Fifth Day of November, 2002

*Attest:*

*Attesting Officer*

JAMES E. ROGAN
*Director of the United States Patent and Trademark Office*